US009383760B2

(12) United States Patent
Porras et al.

(10) Patent No.: US 9,383,760 B2
(45) Date of Patent: Jul. 5, 2016

(54) TEMPERATURE-COMPENSATED REFERENCE VOLTAGE SYSTEM WITH VERY LOW POWER CONSUMPTION BASED ON AN SCM STRUCTURE WITH TRANSISTORS OF DIFFERENT THRESHOLD VOLTAGES

(71) Applicant: CENTRO NACIONAL DE TECNOLOGIA ELETRONICA AVANCADA S.A., Porto Alegre (BR)

(72) Inventors: Fernando Chavez Porras, Porto Alegre/RS (BR); Alfredo Olmos, Viamão/RS (BR); Juan Pablo Martinez Brito, Porto Alegre/RS (BR)

(73) Assignee: CENTRO NACIONAL DE TECNOLOGIA ELETRÔNICA AVANçADA—CEITEC S.A., Porto Alegre (BR)

( * ) Notice: Subject to any disclaimer, the term of this patent is extended or adjusted under 35 U.S.C. 154(b) by 0 days.

(21) Appl. No.: 14/621,006

(22) Filed: Feb. 12, 2015

(65) Prior Publication Data

US 2015/0234401 A1 Aug. 20, 2015

(51) Int. Cl.
*G05F 3/24* (2006.01)
*G05F 1/46* (2006.01)

(52) U.S. Cl.
CPC . *G05F 1/468* (2013.01); *G05F 3/24* (2013.01)

(58) Field of Classification Search
CPC ..... G05F 3/10; G05F 3/16; G05F 3/20; G05F 3/24; G05F 3/242; G05F 3/245
See application file for complete search history.

(56) References Cited

U.S. PATENT DOCUMENTS

| | | | | |
|---|---|---|---|---|
| 6,417,553 | B1 * | 7/2002 | Chou et al. | 257/462 |
| 6,563,369 | B1 * | 5/2003 | Comer et al. | 327/538 |
| 7,429,854 | B2 * | 9/2008 | Kimura | 323/315 |
| 7,522,003 | B2 * | 4/2009 | Seth et al. | 330/296 |
| 7,579,898 | B2 * | 8/2009 | Soldera et al. | 327/512 |
| 7,821,310 | B2 * | 10/2010 | Yun et al. | 327/158 |
| 8,072,259 | B1 * | 12/2011 | Isik | 327/538 |
| 8,305,068 | B2 * | 11/2012 | Camacho Galeano et al. | 323/313 |
| 8,330,526 | B2 * | 12/2012 | Vilas Boas et al. | 327/512 |
| 8,432,214 | B2 * | 4/2013 | Olmos et al. | 327/512 |
| 8,687,302 | B2 * | 4/2014 | Hoque et al. | 360/46 |
| 8,896,349 | B2 * | 11/2014 | Vilas Boas et al. | 327/77 |
| 2009/0189683 | A1 * | 7/2009 | Wu | 327/543 |

* cited by examiner

*Primary Examiner* — Thomas J Hiltunen
(74) *Attorney, Agent, or Firm* — K&L Gates LLP

(57) ABSTRACT

A simple SCM (Self Cascode MOSFET) structure to generate a sub-1V reference voltage in the SCM intermediate node. The structure requires only 2 transistors to create a temperature-compensated reference voltage. When sized correctly, the transistors in the SCM will operate both at weak, moderate or strong inversion, and in the saturation region or saturation and triode regions, providing good correspondence and low part to part variation. The following proposal innovates by operating with supply voltages on a broad variation range, from 3.6V through below 1V (sub-1V operation), with bias currents in the range of tens of nA (nano Amperes) and temperature variation smaller than ±1% from −40° C. through 85° C. This is an extremely low cost implementation (in terms of area and complexity), compatible with standard CMOS manufacturing processes, and very robust (in terms of fab-to-fab transference, technology mapping, and also well controlled part-to-part variation).

16 Claims, 2 Drawing Sheets

TEMPERATURE-COMPENSATED REFERENCE VOLTAGE SYSTEM WITH VERY LOW POWER CONSUMPTION BASED ON AN SCM STRUCTURE WITH TRANSISTORS OF DIFFERENT THRESHOLD VOLTAGES

CROSS REFERENCE TO RELATED APPLICATIONS

This application claims priority to and the benefit of Brazilian Patent Application No. 1020140035478, filed on Feb. 14, 2014, the entire disclosure of which is incorporated by reference herein.

FIELD OF THE INVENTION

Generally, the present invention belongs to the technological field of electronic systems and more specifically refers to reference voltage circuits.

BACKGROUND OF THE INVENTION

The technologies concerning the development and manufacturing of semiconductors have advanced exponentially. Nowadays, the processed transistors have diminished in size and area of an integrated circuit (IC). This is an extremely important fact since a greater range of devices and integrated circuits can be employed and implemented, providing the possibility of adding more functions to a single chip, thus reducing the required area and power consumption.

Reference voltage circuits are essential blocks for the development of analog and mixed signal blocks such as voltage regulators, AD converters, flash memories, DRAM memories, switched capacitor circuits, RF communication blocks, comparators, etc. The power required by advanced systems has achieved increasingly low and tight levels, particularly in RF and biomedical system applications due to the limitations in the available power. In this case, the reference voltage circuits must be able to operate at wide supply voltage ranges, from a few volts through below 1 volt due to the broad operation range of the RF systems, where the operation voltage depends directly on the incoming RF signal power at the antenna. Therefore, to provide a sub-1V reference voltage with extremely low power consumption to keep up with this natural evolution, new topologies are required to support the growing and dynamic RF market demand.

Conventional circuits used as temperature-compensated reference sources are usually built by adding two terms easily found in IC design. The first one is the forward bias voltage of a PN junction ($V_f$), while the second one is the thermal voltage ($V_t$) equal to KT/q, where K is the Boltzmann constant, T is absolute temperature, and q is the electron charge. Note these two terms have opposite behaviors over temperature namely CTAT (Complementary-to-Absolute Temperature, or with a negative temperature coefficient), and PTAT (Proportional-to-Absolute Temperature, or with a positive temperature coefficient) respectively. When designed and properly scaled, the addition of these two terms provides a first order temperature-compensated reference voltage usually in the order of 1.2V in silicon (Si) technologies, also known as bandgap voltage.

However, the reference voltages have changed the concept of circuits because of the evolution of the technologies (lower supply voltages) and the need for extremely reduced energy consumption. Thus, in a search for new solutions capable of overcoming the challenges posed by these new technologies, several methods to develop reference voltages below 1 volt have been developed. Among the first proposed approaches to develop reference voltages below 1 volt is the one presented in 1999 by H. Banba., S. Hitoshi, U. Akira, and M; Takeshi. They presented a reference voltage derived from the addition of two currents generated by a single feedback loop, such currents being proportional to a forward biased diode voltage and a thermal voltage (KT/q). The reference voltage obtained depends on the relation of two resistors. The authors claim a 518 mV+/−15 mV reference voltage for a 3 sigma spread. The minimum simulated supply voltage was 0.84V and the reported current consumption was 2.2 uA. These values do not satisfy the need to operate with a power consumption below 1 uA.

In a second solution, S. Mehmarmanesh, M. B. Vahidfar, H. A. Aslanzadeh, and M. Atarodi propose a reference voltage based on a structure in a regulated current mode with some feedback loops to achieve operation at low voltage and low power. The authors claim that the technique employed features a high impedance power supply. On the other hand, K. N. Leung, and P. Mok propose a reference voltage based on the thermal coefficient difference presented by the threshold voltage ($V_{th}$) of a PMOS transistor and a NMOS transistor. Thus, a reference voltage can be built to achieve low temperature variation mutually compensating the transistors' $V_{th}$ temperature variations, that diminish with temperature on a linear basis in a first-order approximation (i.e., the $V_{th}$ of a MOS transistor has a CTAT behavior). The minimum supply voltage achieved was 1.4V; the minimum consumption achieved was 9.7 uA, and the temperature variation was 36.9 parts per million per Celsius degrees (ppm/° C.). The presented values do not satisfy the need to operate with a power consumption below 1 uA and a low supply voltage.

Giuseppe de Vita and Giuseppe Iannaccone proposed a reference voltage of extremely low power consumption operating at a supply voltage between 0.9V and 4V. The proposed structure features a 70 nA current consumption. The authors claim that the reference voltage generator features a temperature variation of 10 ppm/° C., that is achieved by means of a perfect elimination of the mobility dependence on temperature, compensation for the channel modulation effect, and the absence of the body effect. A. Aldokhaiel, A. Yamazaki, and M. Ismail proposed a reference voltage that uses the so-called body-drive technique, that allows the circuit to be operated at low supply voltages without requiring low-threshold voltage devices. The authors claim that the technique used features a greater common-mode range. S. Mingoo, D. Sylvester, D. Blaauw, S. Hanson, and G. Chen have recently invented what they call an improved reference generator, that consists of two serially connected transistors operating in the weak inversion region and with different threshold voltages where the transistor with larger $V_{th}$ is connected as a diode while the transistor with lower $V_{th}$ is serially connected to ground. The lower $V_{th}$ transistor consists of a native transistor whose gate is connected to ground. The authors claim that any combination of devices will work providing there is a considerable $V_{th}$ difference. The reference voltage is obtained at the intermediate node between the two transistors and its value depends on the size of both transistors and the bias point of the transistor with larger $V_{th}$. The expression for the reference voltage contains two terms with opposite temperature dependence differentiating the $V_{th}$'s and the (KT/q) thermal potential [7].

It is important to mention that a large part of the previously mentioned studies satisfy the need to implement a generator with a reference voltage below 1V. However, the power consumption in most of them is in the order of microamperes, evidencing a greater energy consumption required for the systems to operate perfectly.

Based on the aforementioned studies, improvements and new technologies are being developed and marketed in order to provide new viable solutions with high performance and low power consumption. The U.S. Pat. No. 8,058,863 proposes a bandgap reference voltage circuit encompassing MOS transistors connected to bipolar transistors, apart from employing operational amplifiers. A CTAT voltage is scaled down by a threshold voltage of a NMOS transistor, and a reference voltage lower than or equal to 1V is provided by resistances respectively connected to the bipolar transistors. The patent in question evidences the fact that an additional resistance must be adjusted so that the reference voltage is independent of the temperature. Thus, the inconvenience of using resistances, operational amplifiers, and bipolar transistors is clear since bipolar transistors usually require a large bias current causing high power consumption. The need of a greater number of devices to build the reference voltage circuit is also evident.

Likewise, the US patents and patent applications US20090096509, US20080136504, U.S. Pat. No. 7,259,543, US20060108994 and U.S. Pat. No. 6,501,256 provide solutions to generate sub-iv reference voltages requiring the use of operating amplifiers, bipolar transistors, diodes and/or resistors which make it difficult to achieve low power consumption and low voltage operation simultaneously. Furthermore, these circuits do not feature low-complexity and reduced-size solutions, thus evidencing the high costs involved.

Also according to Huang et al in "A CMOS sub-1V nanopower current and voltage reference with leakage compensation", a voltage and current reference was developed based on a modified polarized SCM structure using 3 bias currents. The reference voltage is below 1V. However, its effective use for supplies lower than 1V is doubtful. The proposed circuit features an apparently simple concept and good compatibility with several MOS manufacturing processes. The temperature compensation depends on the injection of a leakage current making the solution not so reliable.

In "A simple subthreshold CMOS voltage reference circuit with channel length modulation compensation", Huang et al proposed reference voltage generators working at a low power supply voltage but requiring many resistors for good behavior making it unable to achieve low power consumption. Furthermore, in "A new voltage reference topology based on subthreshold MOSFETs", published in ESSCIRC 2002, a similar solution like the previous one is proposed but with a minimum supply voltage of 1.2V, i.e., out of the sub-1V operation range.

Doyle et al propose in "A CMOS sub-bandgap reference circuit with 1V power supply voltage", the use of bipolar transistors, resistors and operational amplifiers to obtain a reference voltage below 1V. Such circuits are relatively complex, occupy a large area, and do not consume low power.

It is also important to consider the US patent application US 20100327842, that proposes a reference voltage generator composed basically of a first transistor with a given threshold voltage and operating in weak inversion, and a second transistor connected in series with the first one. The second transistor also operates in a weak inversion and has a larger threshold voltage than the first transistor. The gate electrode of the second transistor is electrically coupled to the drain electrode of the second transistor, forming an output for the reference voltage. Furthermore, this patent shows several configurations of voltage reference circuits with different bias voltages and various circuit topologies seeking reference voltages depending on temperature.

However, even though the solution proposed by US 20100327842 attains low voltage operation, consumes low power, and consists of a small and simple two-transistor circuit operating at weak inversion, there is a clear part-to-part variation in the reference voltage, thus compromising its temperature compensation. Furthermore, in order to obtain a certain driving capability, an output buffer is required substantially increasing the power consumption. Finally, the architecture is extremely dependant on the power supply voltage as it defines the transistors' inversion level. The reported area in this work is 1 $mm^2$, an area quite considerable.

SUMMARY OF THE INVENTION

In order to eliminate the inconvenience already known in the state of the art, this solution has the purpose of providing a technological migration of a passive identification low frequency RF tag from a 600 nm CMOS technology to 180 nm.

The inventors want to achieve a very low power consumption for the all RF tag circuit (<5 uA during read mode), driving them to propose a new architecture operating at 1.2V and requiring a reference voltage of approximately 570 millivolts (mV).

Therefore, the solution proposes a sub-1V reference voltage circuit based on two NMOS transistors with different threshold voltages already available in the existing CMOS technologies. The results obtained using the available NMOS devices in a standard 180 nm CMOS technology will be presented just as an example. Apart from featuring low power consumption and a reduced area, the proposed circuit is robust in terms of process, voltage, and temperature (PVT) variations.

In short, the present invention has the purpose of providing a reference voltage of extremely low power consumption for analog and mixed-signal circuits with the capacity of generating sub-1V reference voltages using only a modified "Self-Cascode MOSFET" (SCM) structure, and a manufacturing process compatible with the CMOS standard process. Furthermore, the developed solution enables a system to operate over a wide temperature range (from −40° C. to 85° C.) with high precision, also allowing for a wide voltage operation range and featuring simplicity, low cost and small effective area.

Furthermore, it is worthwhile to mention the possibility of using cascaded generators to double, triple, etc. the absolute reference value, as well as the fact that it provides freedom to create the reference potential according to the choice of transistors, based on a simple, robust project.

DESCRIPTION OF THE DRAWINGS

In order for the present invention to be fully understood for someone skilled in the art, it will be described in a clear, concise and sufficient manner based on the attached drawings, that illustrate and complement the topics below.

DETAILED DESCRIPTION OF AN EMBODIMENT

Figure 1:
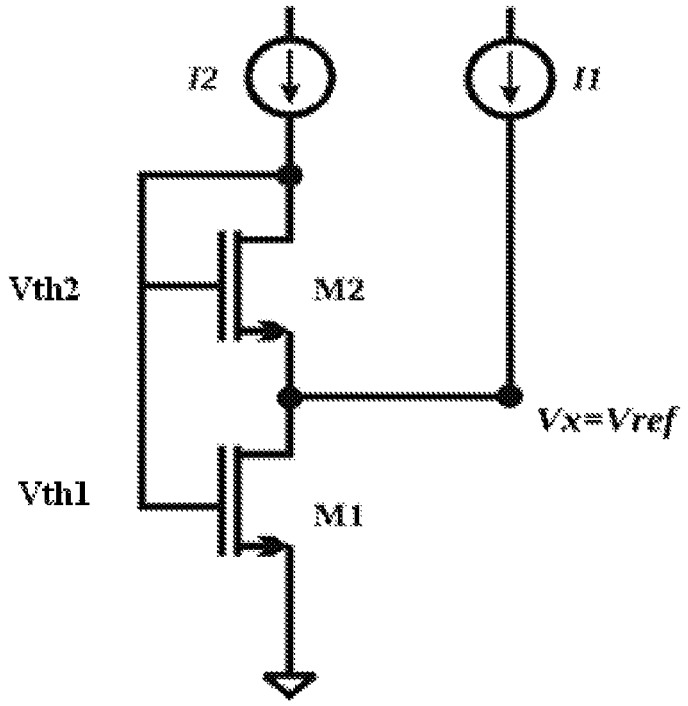
FIG. 1 represents the reference voltage's electrical scheme.

As can be inferred by the attached figures, the present invention consists of using a SCM (Self Cascode MOSFET) structure composed of two transistors with different threshold voltages ($V_{th}$). Furthermore, both transistors are biased with two independent current sources, $I_1$ and $I_2$. These bias currents are still relatively small and within the range of a few nano Amperes (nA), that results in a substantially low power consumption. As can be seen in FIG. 1, the proposed SCM structure has the $M_1$ transistor as an NMOS transistor which has its threshold voltage ($V_{th1}$) larger than the threshold voltage of the $M_2$ transistor ($V_{th2}$), so $V_{th1}>V_{th2}$. The bulk (b) terminal of both transistors is connected to the ground terminal, so the $M_2$ transistor has a body effect ($V_{bs}\neq 0$).

The SCM structure basically consists of two NMOS transistors, $M_1$ and $M_2$, connected so that the $M_2$ source electrode is tied to the $M_1$ drain electrode. The $M_2$ drain electrode is connected to the $M_2$ and $M_1$ gate electrodes. The $M_1$ source electrode is tied to the ground terminal.

Two current sources are connected to the $M_1$ and $M_2$ drain electrodes, allowing the MOSFETs to operate in the saturation region and the triode region, respectively. The $I_2$ current source is connected to the $M_1$ and $M_2$ gate electrodes and to the $M_2$ drain electrode. The $I_1$ current source is connected to the $M_2$ source electrode and to $M_1$ drain electrode. These current sources are implemented as properly matched PMOS current mirrors.

The reference voltage is obtained at the intermediate drain/source terminal between the NMOS transistors. In order to consume low power, the circuit is biased by current sources in the range of a few nA. The circuit is capable of operating in a broad voltage range providing that:

(a) The minimum operation voltage is the threshold voltage of the $M_2$ NMOS transistor plus the $M_1$ NMOS drain-source saturation voltage, plus approximately 100 mV to keep the PMOS current mirrors in saturation.

(b) The maximum reference voltage is limited by the type of adopted NMOS transistor types (a combination of devices with low, medium and high $V_{th}$).

The minimum effective area of this robust architecture supports simple transference from fab-to-fab, while maintaining low variation from part-to-part. Since the circuit provides a sub-1V reference voltage, it is ideal for battery applications, as well as for power harvesting systems, such as RFID tags, and analog and digital circuits of extremely low power consumption, etc.

The reference voltage can be computed by the equation:

$$Vx = \phi_t\left[\sqrt{1+if_1} - \sqrt{1+if_2} + \ln\left(\frac{\sqrt{1+if_1}-1}{\sqrt{1+if_2}-1}\right)\right] + [V_{P2} - V_{P1}] \quad (1)$$

where $\phi_t$ is the thermal potential $$\left(\Phi_t = K\cdot\frac{T}{q}\right),$$

and $I_{f1}$ and $I_{f2}$ are the inversion levels of the $M_1$ and $M_2$ transistors, respectively. The inversion level is defined by $$if = \frac{I_D}{I_S};$$

where $I_D$ is the transistor drain current and $I_S$ the specific current. The specific current ($I_S$) is the normalization current of an MOS transistor times the transistor's aspect ratio (W/L). In the ACM model, $I_S$ is defined as:

$$IS = \mu\cdot Cox\cdot\eta\cdot\frac{\phi_t^2}{2}\frac{W}{L},$$

where μ is the mobility of the carriers, $C_{ox}$ is the gate oxide capacitance per area, η is known in the literature as the slope factor, and W and L are the transistor's width and length, respectively. $V_{P2}$ and $V_{P1}$ are the pinch-off voltages of the transistors $M_1$ and $M_2$, respectively. The definition of the pinch-off voltage is $$VP = \frac{V_{GB} - Vth}{\eta},$$

where $V_{GB}$ is the gate-bulk voltage.

As can be seen in equation 1, the term of the first bracket is a function of the inversion levels multiplied by $\phi_t$. In other words, this part of the equation has a behavior proportional to the absolute temperature or PTAT. The variation of the inversion level with the temperature is negligible as the current has to change in several orders of magnitude to affect the value of the inversion factor. Therefore, there is a constant factor multiplying the thermal potential where the variable of interest is the temperature.

On the other hand, as the transistors have the same gate-bulk voltage ($V_{GB}$) and approximately the same η, but not the same threshold voltage, the difference between the pinch-off voltages is proportional to the difference between the threshold voltages ($V_{th1}-V_{th2}$). This creates a CTAT potential with a negative temperature coefficient. Consequently, as definition of any temperature-compensated reference voltage, the addition of a PTAT voltage with a properly scaled CTAT voltage generates a temperature-compensated potential ($V_{REF}$).

Based on the development of this solution, the importance of and the effects generated by biasing with current sources in the range of a few nA an SCM structure composed by two NMOS transistors with different threshold voltages is evident. The technical benefit derived from such configuration is clear.

Since they are properly sized, the NMOS transistors of the SCM structure can operate at weak, moderate or strong inversion, therefore obtaining a temperature-compensated solution. However, the operation of the NMOS transistors at weak or moderate inversion is recommended as transistors operating in strong inversion require a large area for currents in the range of a few nA. In other words, in order to lead the transistors to a strong inversion region, a greater area is required to establish low power consumption. Based on this, in order to not compromise the developed structure, as when the current is reduced the transistors W/L ratio must also be reduced, the most correct solution is to keep the $M_1$ and $M_2$ transistors at a moderate or weak inversion. Thus, the circuit area will not be compromised and there will be low power consumption.

Furthermore, the $M_2$ transistor will always operate in the saturation region. The $M_1$ transistor of the proposed SCM structure may operate in saturation or triode regions obtaining satisfactory temperature compensation. However, it is worthwhile to stress that when the $M_1$ transistor operates in a saturation region, its area is optimized. The power consumption can be within the range of a few tens of nA to get $V_{GB}$+100 mV.

Figure 2:
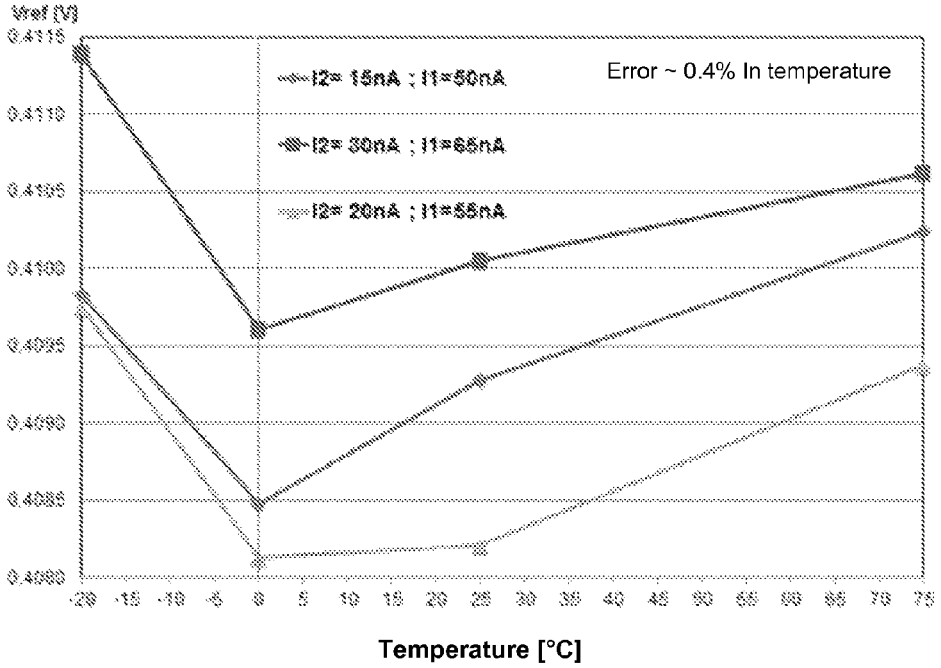
FIG. 2 represents the reference voltage trial results according to temperature for different bias currents.

The trial results presented in FIG. 2 illustrate the reference voltage variation over the temperature. Three different bias conditions are shown demonstrating small variation of the reference voltage despite a large variation of the bias currents.

Therefore, it is clear to stress a substantial reduction of the system's power consumption allowing a reduction of the circuit's useful area. The presented figures and descriptions are not intended to limit the execution methods of the inventive concept proposed herein, but merely to illustrate and clarify the conceptual innovations disclosed in this invention, so the descriptions and images must be interpreted as illustrations and not limitations. There may be other equivalent or analog implementation methods for the inventive concepts presented herein which do not deviate from the protection spectrum outlined in this invention.

This description presented a peculiar and original reference voltage generation system capable of improving its utilization, containing novelty, inventive step, sufficiency of disclosure and industrial application, in other words, featuring all the essential requirements for the grant of the claimed invention.

What is claimed is:

1. Temperature-compensated reference voltage system with very low power consumption based on an Self Cascode MOSFET (SCM) structure, the temperature compensating reference voltage system comprising: a first and a second transistor each having a different threshold voltage ($V_{th}$) and both the first and second transistors operating in saturation and forming an SCM structure and sub-1V reference voltage wherein the first and second transistors are biased by two independent first and second current sources implemented with PMOS current mirrors.

2. The temperature-compensated reference voltage system with very low power consumption based on an SCM structure of claim 1 wherein the first and second transistors are NMOS transistors.

3. The temperature-compensated reference voltage system with very low power consumption based on an SCM structure of claim 1 wherein the first transistor has a larger threshold voltage ($V_{th}$) than the second transistor.

4. The temperature-compensated reference voltage system with very low power consumption based on an SCM structure of claim 1 wherein the minimum operation voltage being the threshold voltage of the second transistor plus the saturation voltage of the first transistor plus approximately 100 mV to keep the PMOS current sources in saturation.

5. The temperature-compensated reference voltage system with very low power consumption based on an SCM structure of claim 1 wherein the maximum reference voltage being limited by the type of adopted transistors from a combination of devices with low, medium and high threshold voltages ($V_{th}$).

6. The temperature-compensated reference voltage system with very low power consumption based on an SCM structure of claim 1 wherein the reference voltage ($V_x$=$V_{ref}$) at the drain of the first transistor is given by the equation:

$$Vx = \phi_t\left[\sqrt{1+if_1} - \sqrt{1+if_2} + \ln\left(\frac{\sqrt{1+if_1}-1}{\sqrt{1+if_2}-1}\right)\right] + [V_{P2} - V_{P1}].$$

7. The temperature-compensated reference voltage system with very low power consumption based on an SCM structure of claim 1 wherein the gate electrode of the first transistor being connected to the gate electrode of the second transistor, the gate electrode of second transistor being tied to the drain electrode of the second transistor, the drain electrode of the first transistor being connected to the source electrode of the second transistor, and the source electrode of the first transistor being connected to the ground terminal.

8. The temperature-compensated reference voltage system with very low power consumption based on an SCM structure of claim 7 wherein the first and second transistors of the SCM structure operate at a weak inversion.

9. The temperature-compensated reference voltage system with very low power consumption based on an SCM structure of claim 7 wherein the first and second transistors of the SCM structure operate at a moderate inversion.

10. The temperature-compensated reference voltage system with very low power consumption based on an SCM structure of claim 7 wherein the first and second transistors of the SCM structure operate at a strong inversion.

11. The temperature-compensated reference voltage system with very low power consumption based on an SCM structure of claim 7 wherein one of the first and second transistors of the SCM structure operates in weak inversion and the other one of the first and second transistors operates in moderate inversion.

12. The temperature-compensated reference voltage system with very low power consumption based on an SCM structure of claim 7 wherein one of the first and second transistors of the SCM structure operates in weak inversion and the other one of the first and second transistors operates in strong inversion.

13. The temperature-compensated reference voltage system with very low power consumption based on an SCM structure of claim 7 wherein one of the first and second transistors of the SCM structure operates in moderate inversion and the other one of the first and second transistors operates in strong inversion.

14. The temperature-compensated reference voltage system with very low power consumption based on an SCM structure of claim 1 wherein the second current source being connected to the gate electrode of both the first and second transistors and the first current source being connected to the source electrode of the second transistor and drain electrode of the first transistor.

15. The temperature-compensated reference voltage system with very low power consumption based on an SCM structure of claim 1 wherein the circuit is configured to make use of a standard CMOS technology and consumption in the nA (nano Amperes) range.

16. The temperature-compensated reference voltage system with very low power consumption based on an SCM structure of claim 1 wherein the pinch-off voltage difference ($V_{p2}$-$V_{p1}$) is proportional to the difference between the threshold voltages of the first and second transistors ($V_{th1}$-$V_{th2}$).

* * * * *